United States Patent [19]

Doughty

[11] Patent Number: 4,614,345

[45] Date of Patent: Sep. 30, 1986

[54] AUTOMATIC RESETTING TARGET

[76] Inventor: Steven P. Doughty, P.O. Box 23084, Jacksonville, Fla. 32241

[21] Appl. No.: 715,174

[22] Filed: Mar. 22, 1985

[51] Int. Cl.[4] ..... F41J 5/06; F41J 7/00

[52] U.S. Cl. ..... 273/381; 273/392

[58] Field of Search ..... 273/381, 390, 391, 392

[56] References Cited

U.S. PATENT DOCUMENTS 2,899,204 8/1959 Ratay ..... 273/392

4,373,733 2/1983 Smith ..... 273/392 X

*Primary Examiner*—Anton O. Oechsle

[57] ABSTRACT

The disclosed target is an all steel constructed target which rocks upon impact of the energy of the bullet's velocity and resets itself under its own counterweight design. The screw-on plate offers ease in changing plates for shooting at different yardages and inexpensive replacement of the plate without having to replace the entire target. The shooter will enjoy the advantages of shooting at a target which resets itself and offers quick and easy replacement of the target plate.

1 Claim, 9 Drawing Figures

AUTOMATIC RESETTING TARGET

FIELD OF INVENTION

The target of my invention is a steel target for shooters which resets itself after being hit by a bullet.

BACKGROUND

Since man invented the firearm he has sought for an object to shoot at during peace time. Man has shot at cans, bottles and bulls eye targets. As firearms became more sophisticated, the demand for better targets increased. However, only in the last five years has the popular steel shooting come into its own. Steel offers sound and reaction, but the steel targets presently being used have to be reset after every hit.

Targets constructed according to my invention offer the public and law enforcement agencies a new concept in steel shooting. This steel target offers sound, reaction and the automatic resetting of the target object. In between each shot there is a clank sound to report a hit after the bullet has made a good strike. The steel is durable and can be replaced with a larger or smaller diameter plate for different yardages.

DRAWINGS

DESCRIPTION OF THE TARGET/OPERATION OF THE TARGET

Figure 1:
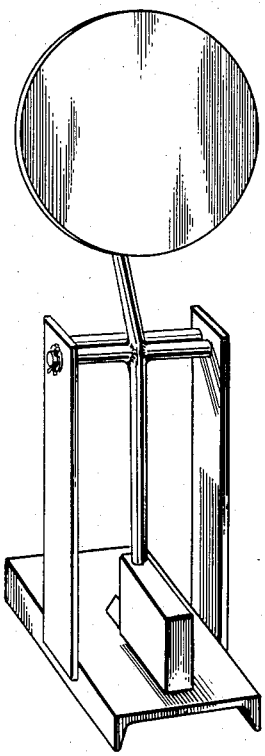
FIG. 1 is a front view of my invention.
Figure 2:
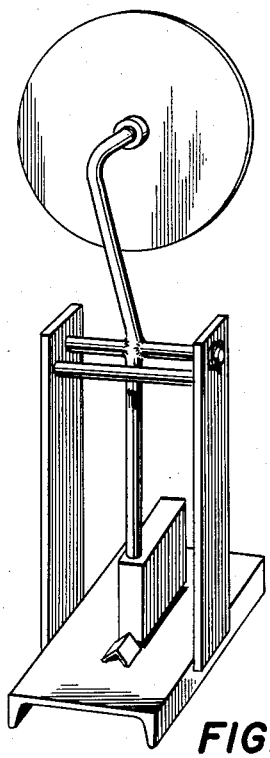
FIG. 2 is a rear view of the target.
Figure 3:
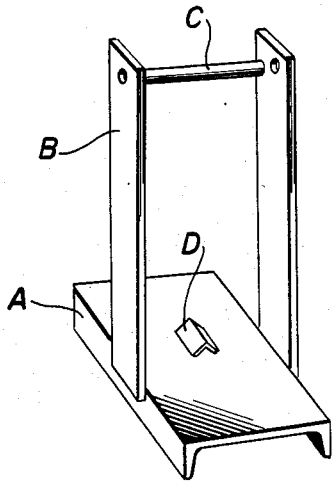
FIG. 3 is a front view of the base made up of (a) the foot, (b) the columns, (c) the stem stop, and (d) the counterweight stop.

There are three separate parts to the Redi-Set Target. The first is the base as shown in FIG. 3. The foot (a) is constructed of a 12 inch piece of 5 inch channel steel. The legs of the channel steel are to be placed down in the earth allowing the channel back to be exposed upward. The columns (b) are made 11½ inch long, ¼ inch thick and 3 inch wide flat bar steel. There are two columns which are permanently bonded by weld. At one end of each column is a ½ inch hole drilled about ½ inch from the end and centrally located from the edges which are ¼ inch thick. Between the columns welded to the 5 inch channel is (d) a counterweight stop. This may be made of any size metal. At the top end of the columns near the ½ inch holes is a support rod (c) of ½ inch cold rolled steel. This rod goes between the columns to ensure the 5 inch separation as the 5 inch channel does at the bottom of the columns.

Figure 4:
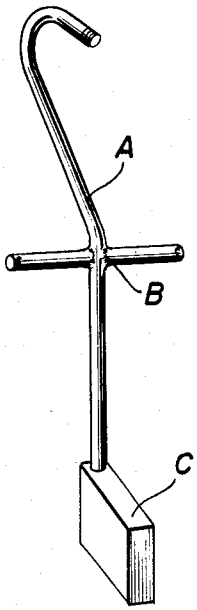
FIG. 4 is a front view of the stem piece with a threaded tip and (a) the FIG. 7 stem, (b) the axle, and (c) the counterweight.

The second major part of the target is the stem. As shown in FIG. 4 the stem is constructed of a ½ inch diameter, 17 inch long piece of cold rolled steel. Permanently attached by weld to one end of the stem is a 1 inch×3 inch steel flat bar used as a counterweight (c) to the target plates (FIGS. 5 and 6) located at the other end of the stem upon complete assembly. About half way up the stem is the axle (b) made ½ inch cold rolled steel and attached by weld. The axle is about 6¼ inch long and is connected to the stem midway along the axle's length. The axle is attached to the base by way of fitting the ends of the axle into the column holes which are about ½ inch from the top of the columns. These holes are countersunk on each side of each column to allow for limited bearing resistance. This enables the stem unit to rock back easier than had they not been countersunk. Keeping the axle from slipping through the column holes after repeated impact with the bullets are cotter pins pressed through small holes drilled through the diameter of the axle ends or tips on each side outside the columns. Washers are used to take up any excessive play to aid in the center adjustment of the stem between the columns. This ensures balance and consistency in target performance.

From the axle up to the actual target plate (FIGS. 5 and 6) the stem is bent in a FIG. "7". This FIG. "7" design enables the target plate to be more centrally located over the axle, thus offering better performance in the rocking activity for which the target is originally designed. The shooter will no longer have to set the target plate back up between each impact. At the upper end or tip of the stem (FIG. 4) are threads with which to mate the target plate (FIGS. 5 and 6).

Note that the FIG. "7" design from the axle up is subject to change slightly in the height of the "7" or the reach of the top arm of the "7". This offers the flexibility of the product to control the speed to which the target may reset itself. This allows for the novice sport shooter and the fast expert shooter who may demand a rapid return to challenge his/her rapid fire shooting ability.

Figure 5:
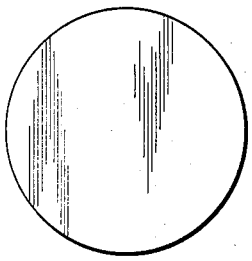
FIG. 5 is the front view of the plate.
Figure 6:
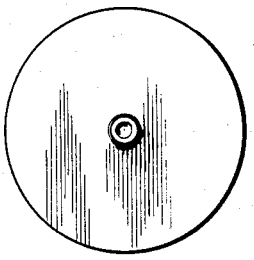
FIG. 6 is the rear view of the plate.
Figure 7:
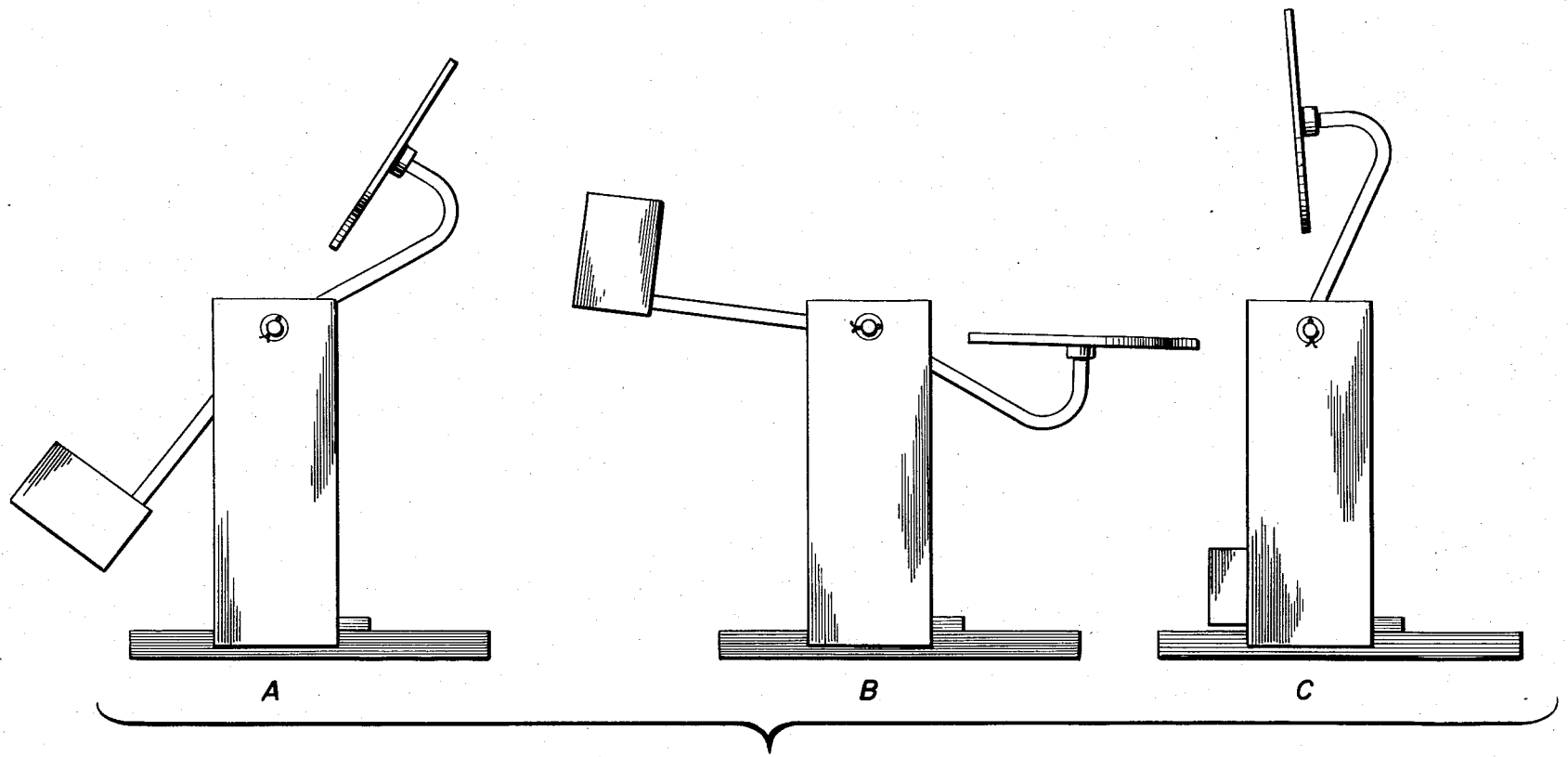
FIG. 7 shows the action of the target (a) as the bullet hits, (b) as the target hits the stem stop and (c) after the target returns to its original position.

The third unit of the target mechanism is the target plate as shown in FIGS. 5 and 6. This is a circular shaped plate, but no limited to a circle. On one side of the target plate is a nut connected by weld to the target plate (FIG. 6). This nut has mating threads to the stem. The mating procedure is done by aligning the stem tip or end (FIG. 7) to the orifice of the nut left exposed as the other open end is flat against the target plate. Once properly aligned turn the plate as one would a steering wheel. After reaching the end of the thread travel give the plate an extra tightening tug to ensure a firm fit to endure the coming impact and turbulance. The entire process of the operation of the target is described above and seen in FIG. 7.

The target of my invention is made of all steel construction and all parts of the target construction may sustain stray rounds. Only the target plate is to be the expected point of impact of the bullet projectile. The plate is made from T-1, an armor-like metal, much harder than the boiler plate metal commonly used in other steel targets.

A unique target design is the ability to replace the target plate without the high cost of the entire target mechanism. Quick spray painting of the target is the optional requirement to refurbish the target. All parts may be removed by hand and likewise to be assembled. Any part may be replaced as an individual unit rather than replacing the entire target.

I claim:

1. A steel target for shooters which resets itself comprising a. a face plate which screws on and off the stem b. a stem with a threaded tip at the top, an axle in the middle and a counter weight at the bottom c. a base constructed of two columns rising from the platform with a stem stop joining the columns at the top and a counter weight stop on the platform.

* * * * *